US005830077A

United States Patent [19]

Yavitz

[11] Patent Number: 5,830,077

[45] Date of Patent: Nov. 3, 1998

[54] IMPACT DETECTOR FOR USE WITH A GOLF CLUB

[76] Inventor: Edward Q. Yavitz, 3828 Spring Creek Rd., Rockford, Ill. 61114

[21] Appl. No.: 874,313

[22] Filed: Jun. 13, 1997

[51] Int. Cl.[6] ..... A63B 69/36

[52] U.S. Cl. ..... 473/226; 473/280; 473/378; 473/236; 473/224

[58] Field of Search ..... 473/224, 225, 473/236, 237, 268, 280, 351, 378, 219, 226

[56] References Cited

U.S. PATENT DOCUMENTS

| | | | |
|---|---|---|---|
| 1,842,944 | 1/1932 | O'Brien . | |
| 2,660,436 | 11/1953 | Grossman | 473/237 |
| 3,435,554 | 4/1969 | Philips . | |
| 3,731,928 | 5/1973 | Wolfe | 473/451 |
| 3,754,764 | 8/1973 | Manheck | 473/237 |
| 3,806,132 | 4/1974 | Brandell | 473/237 |
| 4,191,378 | 3/1980 | Morin et al. | 473/224 |
| 4,234,184 | 11/1980 | Deleens et al. | 473/385 |
| 4,676,508 | 6/1987 | Dilny | 473/280 |
| 4,898,389 | 2/1990 | Plutt | 473/223 |
| 4,974,851 | 12/1990 | Closser | 473/237 |
| 5,142,309 | 8/1992 | Lee | 473/237 |
| 5,522,594 | 6/1996 | Taylor | 473/282 |
| 5,620,382 | 4/1997 | Cho et al. | 473/331 |

*Primary Examiner*—Sebastiano Passaniti
*Attorney, Agent, or Firm*—Fletcher, Yoder & Edwards

[57] ABSTRACT

A device for assisting a golfer in improving his or her golf swing. The device includes an impact detector mounted to the club head of a golf club. The impact detector provides an instantaneous visual or audible indicator of when a predetermined area, e.g., the "sweet spot", of the club head face strikes the golf ball.

14 Claims, 2 Drawing Sheets

IMPACT DETECTOR FOR USE WITH A GOLF CLUB

FIELD OF THE INVENTION

The present invention relates generally to a system or device for improving individual's golf swing, and particularly to a device that provides an instantaneous indication of whether the golfer is striking the golf ball with the "sweet spot" of the golf club head.

BACKGROUND OF THE INVENTION

To achieve the best golf ball travel, golfers must have a proper golf swing that consistently brings the face of the golf club head into proper contact with the golf ball. The head of a typical golf club tends to have a unique area, sometimes referred to as the "sweet spot", that must be brought into contact with the golf ball to obtain the best distance and control over the travel of the ball. Golfers routinely try to perfect their swing to obtain consistent proper contact between the club head and the ball, but it is sometimes difficult to detect whether the "sweet spot" of the particular club head is impacting the golf ball.

Various types of tapes have been designed to help determine whether the club head is being brought into proper contact with the golf ball. These tapes are adhered over the club head face or a portion of the face. The golfer then takes his normal golf swing, resulting in an impression or mark on the tape at the area of the club head face where it impacted the ball. However, the golfer does not receive an instantaneous indication of whether he or she properly struck the ball. Rather, the club must be inverted and the tape physically examined to determine the point of impact between the club head face and the golf ball. Thus, there is an unwanted time lag between the actual golf swing and determination of whether that swing led to proper striking of the ball. This time lag renders it more difficult for the golfer to improve his or her golf swing. Additionally, the tape can only be used for a few swings before the number of marks on the tape creates difficulty in determining which mark is associated with a given swing.

It would be advantageous to have an impact detector able to provide an instantaneous indicator of whether a desired predetermined area of the club head face impacted the golf ball.

SUMMARY OF THE INVENTION

The present invention features a system for assisting an individual improve his or her golf swing by detecting whether a golf ball is struck at a specific area of a club head face of a golf club during the golf swing. The system includes a golf club having a shaft connected to a club head, the club head being of the type having a face. An impact detector is located at a predetermined area of the face. This impact detector is designed to provide the individual with an instantaneous indication of whether the impact detector strikes the golf ball during the golf swing.

According to another aspect of the invention, a golf club head system includes a club head having a club head face. A detector is located at a predetermined area of the club head face. The detector is designed to provide an instantaneous indicator when a golf ball is struck by the club head face at the predetermined area. According to more specific aspects of the invention, the instantaneous indicator may be a unique audible indicator or a visible indicator.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
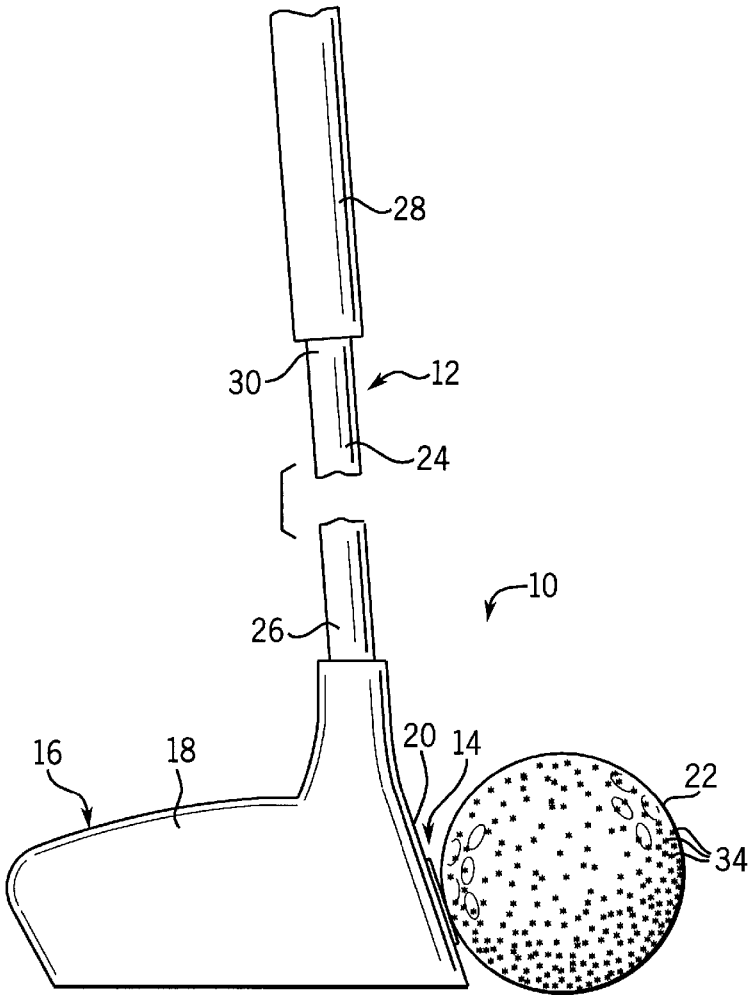
FIG. 1 is a side view of a club head of a golf club contacting a golf ball.
Figure 2:
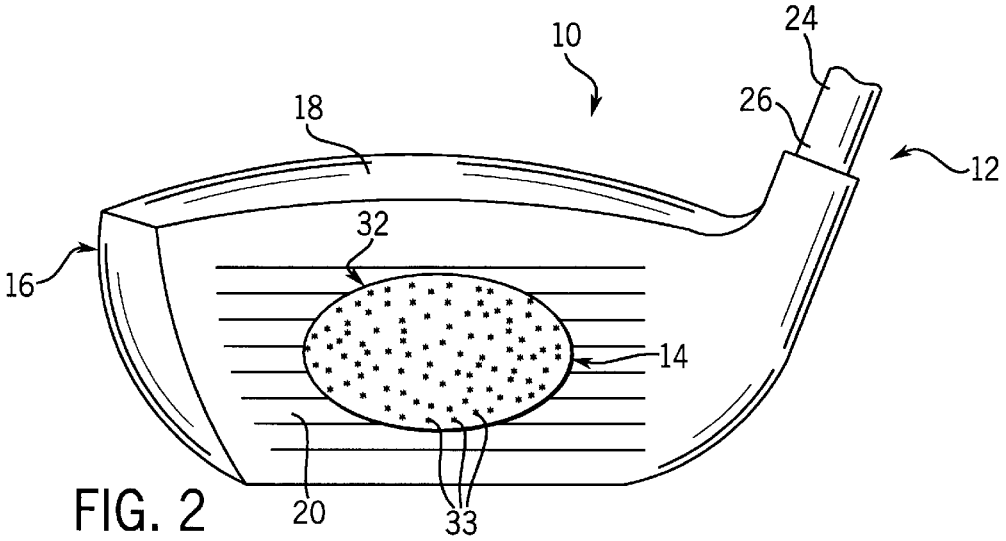
FIG. 2 is a front view of the club head face of the club head illustrated in FIG. 1.

Referring generally to FIGS. 1 and 2, a system 10 for helping a golfer improve his or her golf swing is illustrated according to a preferred embodiment of the present invention. System 10 includes a golf club 12 and a detector 14 that may be mounted to golf club 12.

Golf club 12 may be a conventional golf club, such as a wood, an iron or another type of club used by golfers. Typically, golf club 12 includes a club head 16 having a body portion 18 and a club head face 20 oriented for striking a golf ball 22 during a golfer's swing.

Golf club 12 further includes a shaft 24 connected to club head 16 at a first shaft end 26. A grip 28 is mounted to shaft 24 at a second shaft end 30.

In the illustrated embodiment, detector 14 is designed to detect when a predetermined area 32 of club head face 20 strikes or impacts golf ball 22. Typically, predetermined area 32 is the "sweet spot" of club head face 20, although predetermined area 32 could be disposed at other locations along club head face 20 to help the golfer understand and improve his or her golf swing.

In one preferred embodiment, detector 14 provides a visual indication of contact between detector 14 and golf ball 22 when the area of impact between club head 16 and golf ball 22 is predetermined area 32. In this embodiment, detector 14 may comprise zirconium attached to club head face 20. For example, zirconium particles 33 may be adhered or plasma sprayed onto club head face 20 throughout predetermined area 32.

With this embodiment, it is desirable to properly prepare golf ball 22 such that a visible spark is created when the ball is impacted by club head face 20 at predetermined area 32. A preferred method of preparing golf ball 22 is to spray coat the exterior of ball 22 with a zirconium powder 34 that may be adhered to golf ball 22 with an appropriate binder or adhesive. Alternatively, zirconium particles may be embedded into or molded with the outer cover of golf ball 22. When zirconium strikes zirconium, a clearly visible spark is produced. Thus, each time the golfer properly strikes the zirconium within predetermined area 32 against the zirconium coated golf ball 22, an instantaneous indicator, i.e., a spark, is emitted. The golfer knows instantaneously that golf ball 22 has been struck by the desired area of club head face 20. Another advantage of the instantaneous indicator is that it tends to draw the golfer's attention toward the ball through the point of contact between club head 16 and golf ball 22. This prevents the golfer from inadvertently lifting or turning his or her head prior to striking the ball.

Figure 3:
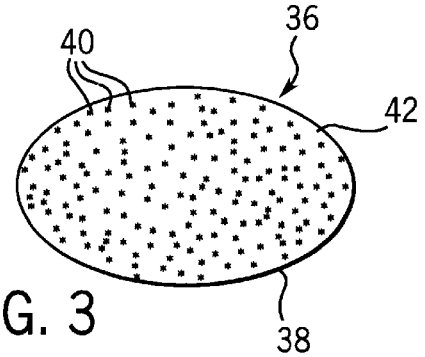
FIG. 3 is a front view of an alternate embodiment of an impact detector.
Figure 4:
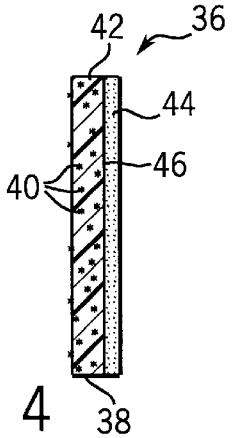
FIG. 4 is a side view of the impact detector illustrated in FIG. 3.

An alternate embodiment of detector is illustrated in FIGS. 3 and 4. Unlike the permanently mounted detector 14 illustrated in FIGS. 1 and 2, the detector shown in FIGS. 3 and 4 is a removable detector 36. Removable detector 36 is preferably a pad that may be designed in a variety of shapes and forms, including elongated strips on rolls as with tape. In the preferred embodiment, removable detector 36 has a perimeter 38 shaped to generally match the perimeter of predetermined area 32 of a given club head face 20. Removable detector 36 is designed to provide an instantaneous visual indication of impact with golf ball 22 during a golf swing. This instantaneous visual indication may be provided by a plurality of zirconium particles 40 held by a support layer 42. With this type of visual indicator, golf ball 22 should be appropriately prepared with, for example, a coating of zirconium particles that will create a visible spark when struck by removable detector 36.

Support layer 42 may be made from a variety of materials, such as plastic. For example, support layer 42 may be an injection moldable plastic in which zirconium particles are integrally molded. Additionally, removable detector 36 preferably includes an adhesive layer 44 applied to a back surface 46 of support layer 42. Adhesive layer 44 is formulated to permit removable detector 36 to be adhered to club head face 20 at predetermined area 32 and later removed.

Other types of detectors may also be used to provide the instantaneous indication of impact between a golf ball and a desired area of the club head face. For example, an instantaneous audible indicator may be provided upon impact. One type of such detector is illustrated in FIG. 5.

Figure 5:
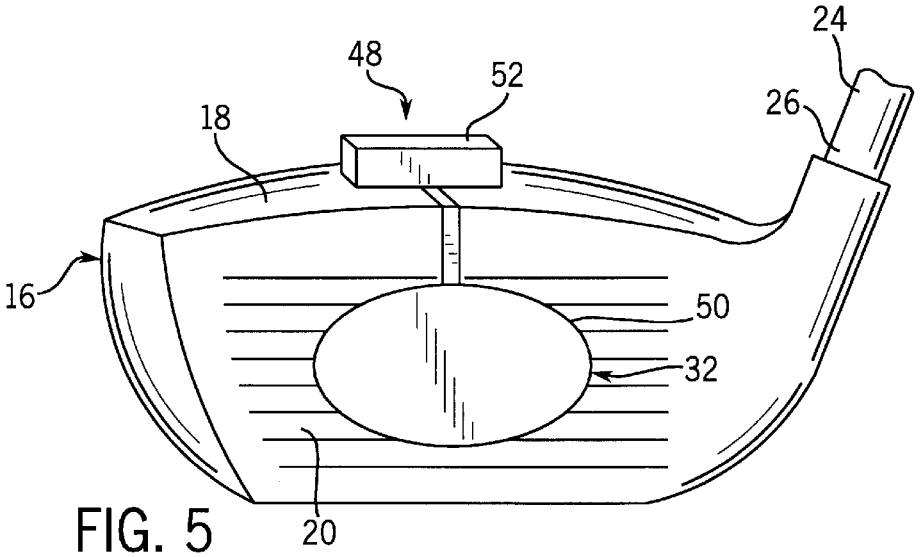
FIG. 5 is a front view of a club head and an alternate embodiment of a detector, according to a preferred embodiment of the present invention.

In the embodiment illustrated in FIG. 5, an audible detector 48 is attached to club head 16 either removably or fixedly. In this particular embodiment, a sensor 50, such as a touch sensor, is mounted to club head face 20 of club head 16. Sensor 50 may be permanently affixed to club head face 20 or removably affixed by, for instance, an appropriate adhesive. Sensor 50 is located at predetermined area 32 of club head face 20, preferably at the club head's "sweet spot".

Sensor 50 is coupled to a sound chip 52, such as those commonly used in a variety of other products, such as toys. Sound chip 52 is designed to provide a unique audible indication of contact between sensor 50 and an object, such as golf ball 22. Each time the golfer properly strikes the golf ball with club head face 20, sensor 50 provides a signal to sound chip 52 which, in turn, provides a unique instantaneous audible indicator to the golfer.

It will be understood that the foregoing description is of preferred exemplary embodiments of this invention and that the invention is not limited to the specific forms shown. For example, a variety of visual and audible or combined visual/audible detectors can be combined with a golf club. Additionally, the detectors can be designed and located to detect when a golfer improperly strikes a golf ball, i.e., misses the "sweet spot". In this embodiment, a visual signal or audible signal is produced when the golfer mis-hits the golf ball. These and other modifications may be made in the design and arrangement of the elements without departing from the scope of the invention as expressed in the appended claims.

What is claimed is:

1. A system for assisting an individual improve his or her golf swing by detecting whether a golf ball is struck at a specific area of a club head face of a golf club during the golf swing, comprising:

a golf club having a shaft connected to a club head, the club head including a face;

an impact detector located at a predetermined area of the face, the impact detector being able to provide the individual an instantaneous indication when the impact detector strikes the golf ball during the golf swing, wherein the impact detector comprises zirconium; and a golf ball, the golf ball having an outer layer that includes zirconium.

2. A system for assisting an individual improve his or her golf swing by detecting whether a golf ball is struck at a specific area of a club head face of a golf club during the golf swing, comprising:

a golf club having a shaft connected to a club head, the club head including a face; and an impact detector located at a predetermined area of the face, the impact detector being able to provide the individual an instantaneous indication when the impact detector strikes the golf ball during the golf swing, wherein the impact detector provides a visible spark upon striking the golf ball, further wherein the impact detector is removable from the face, and the impact detector includes a pad having an adhesive surface by which the pad is adhered to the face.

3. The system as recited in claim 2, wherein the detector comprises embedded zirconium particles.

4. The system as recited in claim 2, wherein the detector is located at a predetermined area of the face, the predetermined area being less than the area of the club head face.

5. A golf club head system, comprising:

a club head having a club head face; and a detector located at the club head face, the detector being disposed for contact with a golf ball and designed to provide an instantaneous visible flame when the golf ball is struck by the club head face at the predetermined area, wherein the detector is affixed to the face and comprises a compound sprayed over at least a portion of the face.

6. The golf club head system as recited in claim 5, wherein the detector comprises zirconium.

7. A golf club head system, comprising:

a club head having a club head face;

a detector located at the club head face, the detector being disposed for contact with a golf ball and designed to provide an instantaneous visible flame when the golf ball is struck by the club head face at the predetermined area; and a golf ball having an outer layer that includes a flame enhancing material.

8. The golf club head system as recited in claim 7, wherein the detector is removable from the face.

9. The golf club head system as recited in claim 7, wherein the detector is affixed to the face.

10. The golf club head system as recited in claim 7, wherein the detector is located at a predetermined area of the face, the predetermined area being less than the area of the club head face.

11. The golf club head system as recited in claim 7, wherein the detector comprises zirconium.

12. The golf club head system as recited in claim 7, further comprising a golf ball, the golf ball having an outer layer that includes zirconium.

13. The golf club head system as recited in claim 7, wherein the impact detector includes a pad having an adhesive surface by which the pad is adhered to the face.

14. A golf club head system, comprising:

a club head having a club head face;

a detector located at the club head face, the detector being disposed for contact with a golf ball and designed to provide an instantaneous visible flame when the golf ball is struck by the club head face at the predetermined area, wherein the detector comprises zirconium; and a golf ball having an outer layer that includes zirconium.

* * * * *